United States Patent [19]

Hubble, III et al.

[11] Patent Number: 4,670,647

[45] Date of Patent: Jun. 2, 1987

[54] DIRT INSENSITIVE OPTICAL PAPER PATH SENSOR

[75] Inventors: Fred F. Hubble, III; Randolph H. Bullock, both of Rochester, N.Y.; Li-Fung Cheung, Los Angeles, Calif.; Robert E. Crumrine, East Rochester; James P. Martin, Dansville, both of N.Y.; Peter P. White, Schaumburg, Ill.; Mehrdad Zomorrodi, Culver City, Calif.

[73] Assignee: Xerox Corporation, Stamford, Conn.

[21] Appl. No.: 655,116

[22] Filed: Sep. 27, 1984

[51] Int. Cl.[4] ..... G03G 15/00; E04G 17/06

[52] U.S. Cl. ..... 250/214 AG; 355/14 SH; 271/265; 271/259; 271/263

[58] Field of Search ..... 355/14 SH, 3 SH; 271/265, 258, 259, 263; 250/548, 559, 571, 561; 250/214 AG, 214 A, 214 B

[56] References Cited

U.S. PATENT DOCUMENTS 3,789,215 1/1984 Penny ..... 250/206
4,097,731 6/1978 Krause et al. ..... 250/205
4,097,732 6/1978 Krause et al. ..... 250/205
4,133,008 1/1979 Tisue ..... 250/214 AG

FOREIGN PATENT DOCUMENTS 0112312 6/1984 European Pat. Off. .

*Primary Examiner*—A. T. Grimley
*Assistant Examiner*—David Warren

[57] ABSTRACT

The present invention is concerned with a self-adjusting document sensor compensating for degradation of the sensor system. A suitable light source and a detector are provided, the output of the detector being fed into an amplifier whose gain depends upon a feedback signal. Periodically, the output of the amplifier is compared to a reference. If the output of the amplifier falls below the reference, a pulse is sent to a ripple counter whose digital output is fed back to the amplifier to change the gain of the amplifier. If the detector is an unbiased photodiode operating in the transconductance mode, the leakage currents and their subsequent effect on output with amplifier gain changes will be minimized.

2 Claims, 10 Drawing Figures

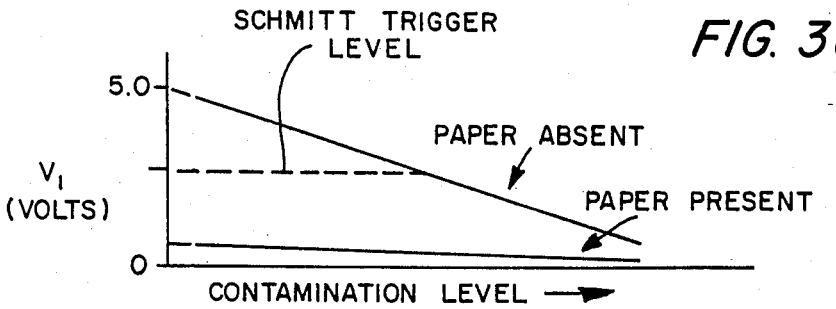
FIG. 3a
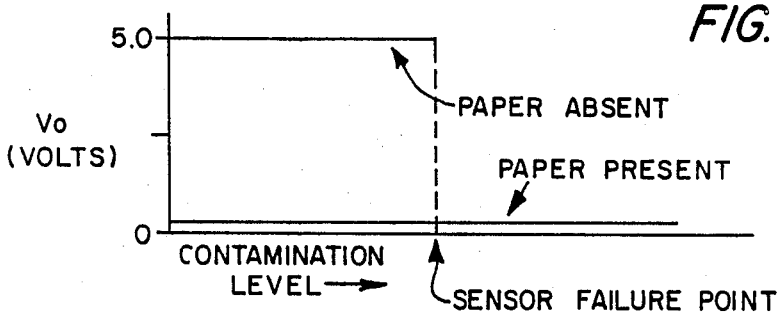
FIG. 3b
FIG. 5
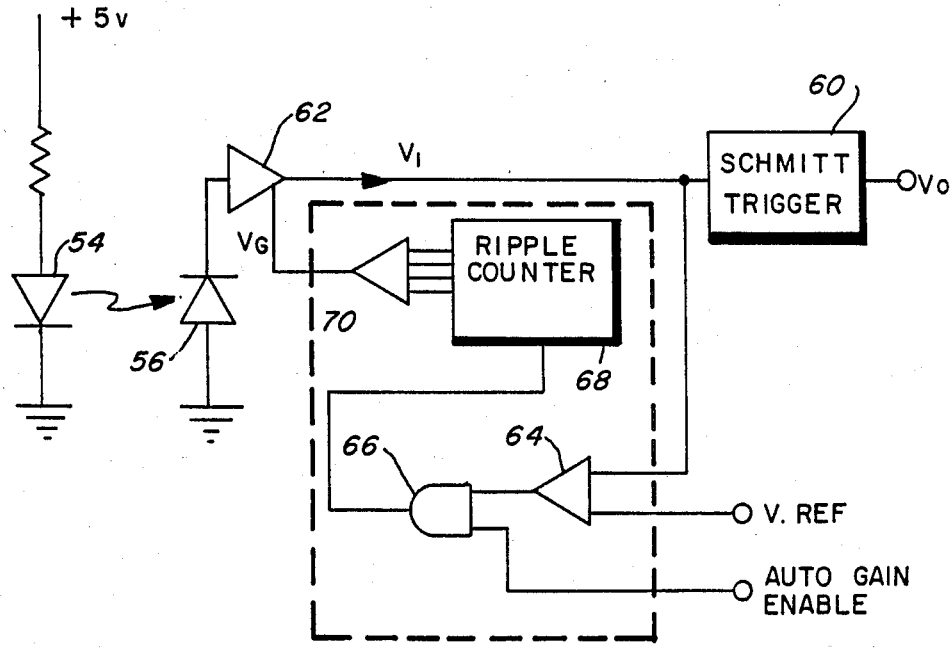

Vo
SCHMITT TRIGGER
V1
78
1x, 81x AMP
76
1x, 9x AMP
74
1x, 3x AMP
73
88
OSC
COUNTER
ENABLE
RESET
86
82
V1
84
V. REF
PULSE GEN.
80
MANUAL RESET
+5v

DIRT INSENSITIVE OPTICAL PAPER PATH SENSOR

The present invention relates to an optical sensor, and in particular, to a self-adjusting sensor to compensate for degradation of the sensor system.

Optical sensors are often used in applications to determine the presence of a copy sheet or document passing through a certain point by providing a suitable signal in response to the copy sheet. Typically, the optical sensor includes a light source whose light beam is directed at the position at which the document is to be sensed. A light sensitive transducer, for example a phototransistor or photodiode, is mounted in aligned relationship with the light source.

A recuring problem in reproduction machines is the contamination of optical sensors, particularly those in the paper path, by airborne toner particles, paper fibers, carrier particles, and other contaminants. These contaminants generally cause failure by coating the optical elements, thereby greatly reducing the illumination level at the sensor.

One solution to the problem is to schedule frequent preventive maintenance periods to clean the sensor and test the level of performance. However, this can be very costly in terms of personnel and increased down time of the machine.

Another problem is the degradation of optical sensors through aging of the light source with corresponding decrease in light output in the sensing region.

It is also known in the prior art to be able to compensate for sensor degradation. For example, U.S. Pat. Nos. 4,097,731 and 4,097,732 teach a sensor having means for regulating the intensity of the sensor light source to compensate for extraneous factors in the operating environment such as dust accumulation, component aging and misalignment. However, this type of compensation, adjusting the power output of the lamp is often relatively complex and expensive and generally provides only a limited degree of adjustment. A much more desirable method of compensation would be to automatically adjust the gain of the received signal rather than to continually adjust the power out of the light source.

U.S. Pat. No. 3,789,215 shows the dectection of documents by establishing thresholds against which the output of a detector must be compared. A difficulty with the system as shown in U.S. Pat. No. 3,789,215 is that its range is limited. For larger degradation, the system is not reliable, and it is insensitive at some portions of the range of detection. In addition, it is necessary to constantly measure and continually update the sample and hold circuitry as well as to compensate for offsets in the amplifier.

It would be desirable, therefore, to provide a compensation circuit that keeps the output of the amplifier at one level, and that is simple and reliable and that can compensate for a wide range of degradation.

It is an object of the present invention therefore to provide a new and improved document sensor that automatically adjusts for sensor degradation. It is another object of the present invention to provide a document sensor in which the detector output is fed into an amplifier and in which the output of the amplifier is periodically adjusted to compensate for system degradation. It is still a further object of the present invention to provide a simple and economic document sensor that is easily adjustable over a wide range of detection.

Further objects and advantages of the present invention will become apparent as the following description proceeds, and the features of novelty characterizing the invention will be pointed out with particularity in the claims annexed to and forming a part of the specification.

Briefly, the present invention is concerned with a self-adjusting document sensor that compensates for degradation of the sensor system. There is provided a suitable light source and a detector, the output of the dectector being fed into an amplifier whose gain depends upon a feedback signal. Periodically, the output of the amplifier is compared to a reference. If the output of the amplifier falls below the reference, a pulse is sent to a ripple counter whose output is fed back to the amplifier to change the gain of the amplifier. If the detector is an unbiased photodiode operating in the zero bias or transconductance mode, leakage currents through the photodiode and their subsequent effect on output with amplifier gain changes will be minimized.

For a better understanding of the present invention, reference may be had to the accompanying drawings wherein the same reference numerals have been applied to like parts and wherein.

Figure 4A:
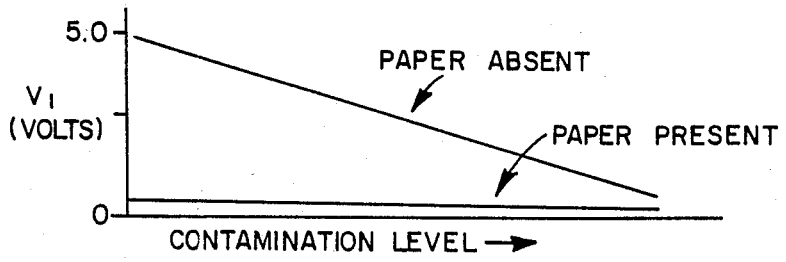
Figure 4B:
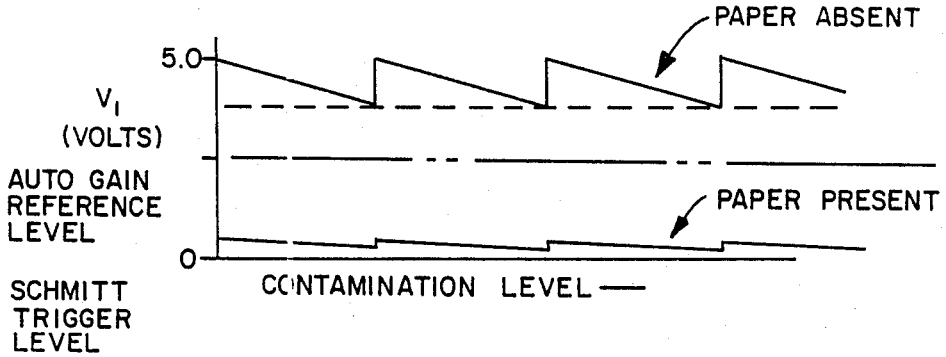
Figure 4C:
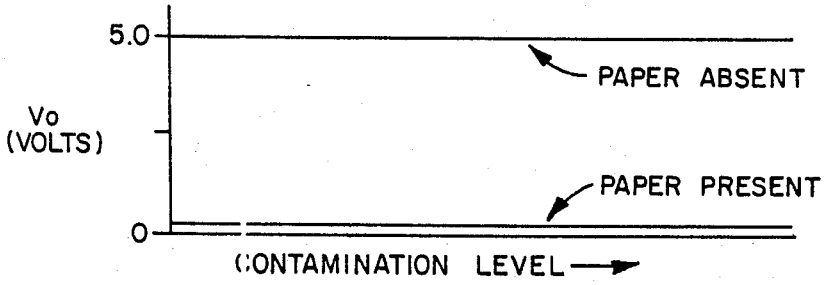
Figure 6:
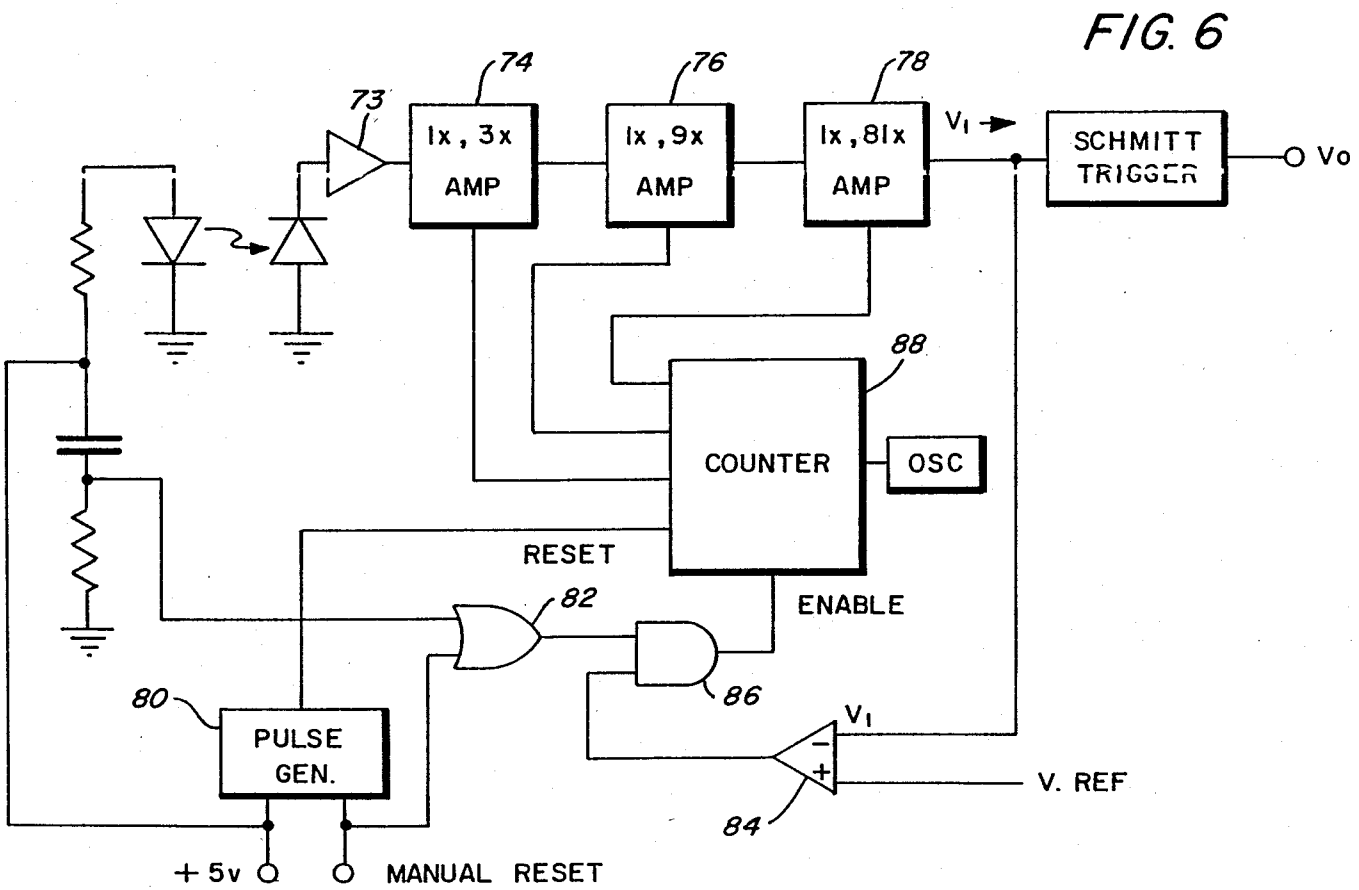

FIGS. 3(*a*) and 3(*b*) illustrate the effects of optical element contamination in prior art systems;

FIGS. 4(*a*) through 4(*c*) illustrate the effects of optical element contamination in accordance with the present invention;

FIG. 5 is a schematic of the sensor and the circuitry for automatically compensating for degradation of the sensor in accordance with the present invention; and FIG. 6 is an embodiment of the present invention.

Figure 7:
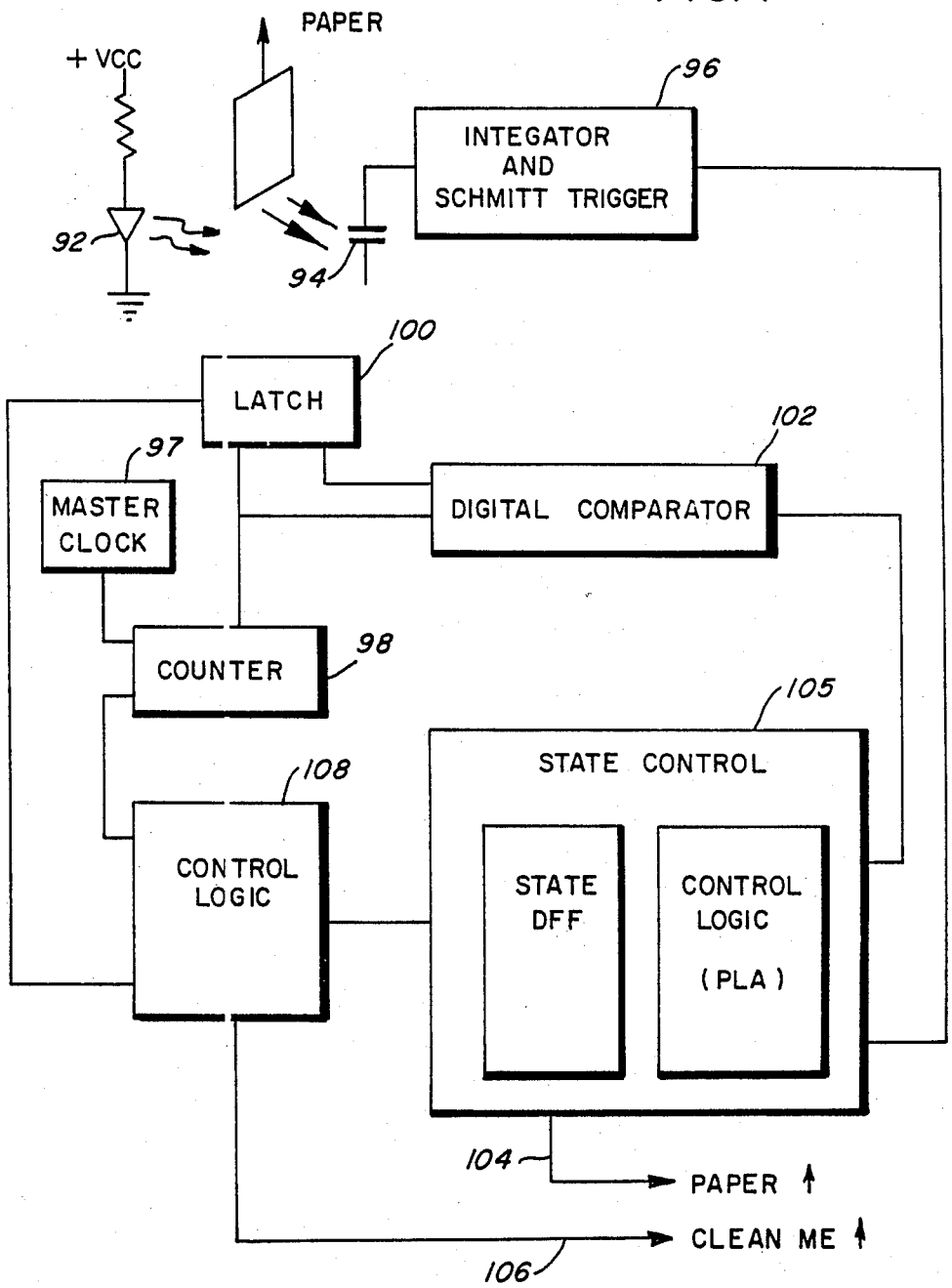

FIG. 7 is a preferred embodiment of the present invention.

Figure 1:
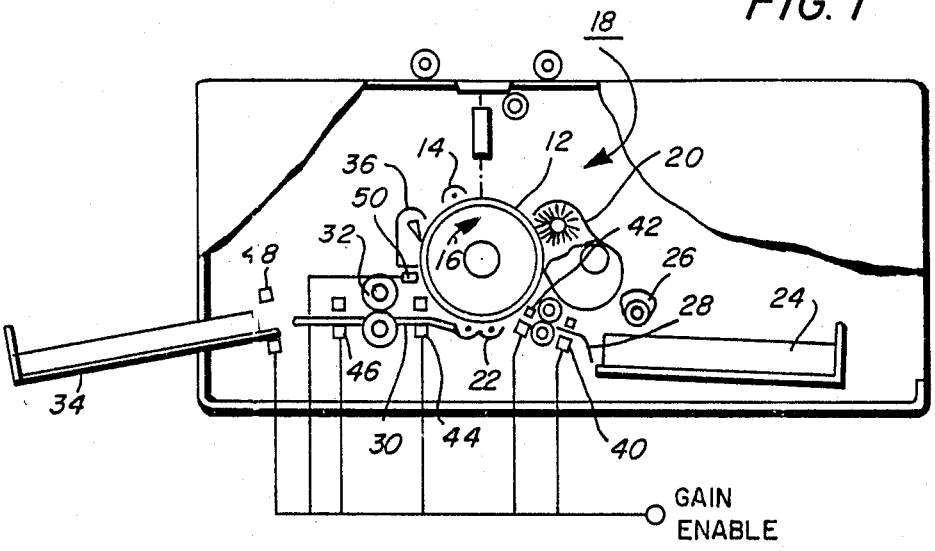
FIG. 1 is an elevational view of a reproduction machine incorporating the present invention.

With reference to FIG. 1, there is illustrated an electrophotographic printing machine having a photoconductive surface 12 moving in the direction of arrow 16 to advance the photoconductive surface 12 sequentially through various processing stations. At a charging station, a corona generating device 14 electrically connected to a high voltage power supply charges the photoconductor surface 12 to a relatively high, substantially uniform potential. Next, the charged portion of the photoconductive surface 12 is advanced through exposure station 18. At exposure station 18, an original document is positioned upon a transparent platen. Lamps illuminate the original document and the light rays reflected from the original document are transmitted onto photoconductive surface 12. A magnetic brush development system 20 advances a developer material into contact with the electrostatic latent image.

At the transfer station 22, a sheet of support material is moved into contact with the toner powder image. The sheet of support material 24 is advanced to the transfer station by sheet feeding apparatus 26 contacting the uppermost sheet of the stack. Sheet feeding apparatus 26 rotates so as to advance sheets from the stack onto transport 28. The transport 28 directs the advancing sheet of support material into contact with the photoconductive surface 12 in timed sequence in order that the toner powder image developed thereon contacts the advancing sheet of support material at the transfer station. Transfer station 22 includes a corona generating device for spraying ions onto the underside of sheet.

This attacts the toner powder image from photoconductive surface 12 to the sheet.

After transfer, the sheet continues to move onto prefuser conveyor 30 advancing the sheet to fusing station 32. Fusing station 32 generally includes a heated fuser roller and a back-up roller for permanently affixing the transferred powder image to sheet 24. After fusing, a chute drives the advancing sheet to catch tray 34 for removal by the operator. There is also included a cleaning mechanism 36 to remove residual toner that may have continued to adhere to the surface 12.

With reference to FIG. 1, there are also illustrated five transmissive paper path sensors and one reflective paper path sensor. In particular, there is illustrated a transmissive paper path sensor 40 at the sheet feed apparatus 26. Another transmissive paper path sensor 42 is disposed just before the transfer station 22, another transmissive paper path sensor 44 is disposed after the transfer station between the fuser 32 and the transfer station 22, and another transmissive paper path sensor 46 is disposed after the fuser station 32. A final transmissive paper path sensor 48 is positioned at the output tray 34. A reflective paper path sensor 50 is disposed along the photoreceptor surface 12 to detect any errant sheet 24 that was not stripped from the photoreceptor drum. As illustrated, all senors are electrically connected to a gain enable line or any other control line to suitably activate the sensors.

Figure 2:
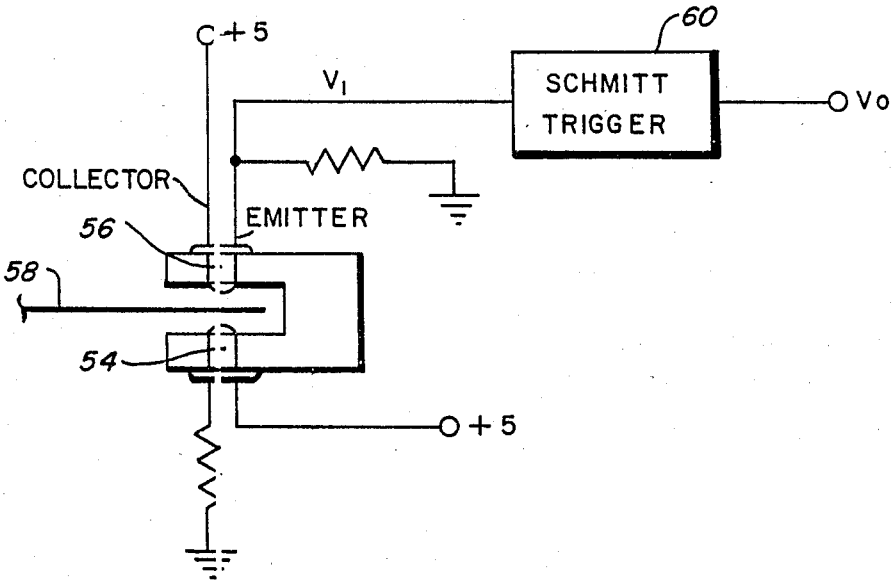
FIG. 2 is a typical transmissive paper path sensor.

With reference to FIG. 2 there is shown a typical transmissive paper path sensor. In particular there is shown a light emitting diode (LED) 54 providing a source of light at a particular paper location. A phototransistor 56 is disposed at the distal end of the station to receive the projected light if there is no paper disposed between the LED 54 and the phototransistor 56. On the other hand, the introduction of paper, illustrated at 58, at the location between the LED 54 and the phototransistor 56 will prevent a large portion of the light transmitted from the LED 54 from reaching the phototransistor 56.

The received light from the phototransistor 56 is converted into an electrical signal illustrated as $V_1$. This signal provides an input to a Schmitt trigger 60 or any other suitable threshold device. The output signal of the schmitt trigger $V_0$, depending upon the input voltage $V_1$, indicates the absence or presence of paper 58 at the paper location.

With respect to FIGS. 3(*a*) and 3(*b*), there is shown the effect on voltage output $V_1$, illustrated in FIG. 2, of progressive degradation of the sensor system. In particular, there is shown a plot of the output voltage $V_1$ of the phototransistor 56 in relation to an increasing contamination level of the optical surfaces of the LED 54 and phototransistor 56. Thus, in FIG. 3(*a*) is a relatively small decrease in the voltage $V_1$ with paper present at the paper location as a result of contamination and a relatively sharp decrease in the voltage $V_1$ output from the phototransistor 56 as a result of contamination with no paper present. The dotted line represent the Schmitt trigger reference level or the input voltage $V_1$ needed to provide a change in output voltage $V_0$.

FIG. 3(*b*) illustrates the relationship of the output voltage of the Schmitt trigger $V_0$ in relation to the increasing contamination reference level. In particular, it is clearly seen that there is an output voltage $V_0$ as long as the input voltage $V_1$ is greater than the Schmitt trigger level. However, as soon as the voltage $V_1$ drops below the Schmitt trigger level due to contamination, there will be no output voltage $V_0$ from the Schmitt trigger. Thus, there is an indication that there is paper present when in fact there is no paper present. The erroneous indication is due to the decrease of the voltage $V_1$ due to the contamination of the optical system.

FIGS. 4(*a*), 4(*b*) and 4(*c*) illustrate the effects of the gain control of the present invention on progressive contamination. FIG. 4(*a*) again generally shows the relationship of the voltage $V_1$ from the phototransistor in relationship to the increase in contamination level with both paper present and the paper absent at the paper station.

With respect to FIG. 4(*b*), there is shown the effects of gain control. In particular, there is shown the level of $V_1$ with paper present and the level with paper absent. In addition, there is illustrated the Schmitt trigger level as well as an auto gain reference level. As the voltage $V_1$ decreases due to contamination, as shown by the saw tooth wave form, it reaches the auto gain reference level illustrated by the dotted line. Reaching the auto gain reference level triggers a feedback circuit to increase the output of an amplifier in order to maintain the voltage $V_1$ at a level above the auto gain reference level and, therefore, above the Schmitt trigger reference level. Thus, as is illustrated in FIG. 4(*c*), even though the contamination level increases, the periodic increase of an amplifier gain of the voltage $V_1$ results in an output voltage $V_0$ consistant with the presence or absence of paper at the paper station.

With reference to FIG. 5 there is shown an electrical schematic of a sensor control in accordance with the present invention. In particular, there is shown an LED 54, photodiode 57 combination and an amplifier 62 electrically connected to the photodiode 57. The amplifier 62 provides a voltage $V_1$ as an input to the Schmitt trigger 60. There is also shown a feedback circuit comprising a comparator 64 connected to AND gate 66, to Ripple counter 68 and to Digital to Analog Converter (DAC) 70. Inputs to the comparator 64 are voltage $V_1$ from amplifier 62 and any suitable reference voltage$_{REF}$. The AND gate 66 periodically receives inputs from an auto gain enable signal and continuously monitors the output of the comparator 64. The output of the DAC 70 provides a signal $V_G$ which controls the gain of the amplifier 62.

As shown in FIG. 5, as light from the LED 54 is made to fall onto the photodiode 56, the output of the photodiode 56 is fed to amplifier 62 whose gain is dependent upon an input signal $V_g$ from DAC 70. The output $V_1$ of the amplifier 62 is compared to reference voltage $V_{REF}$. If the $V_1$ voltage level falls below the reference the output of the comparator is driven high. This allows pulses from the auto gain enable line to be sent to ripple counter 68 through AND gate 66. The output of counter 68 is converted to an analog signal $V_g$ to increase the gain of the amplifier 62. By this means, suitable contrast between paper being absent and paper being present is preserved in spite of degradation of the sensor system due to contaminants. If the detector is an unbiased photodiode operating in the transconductance mode, then leakage currents and their subsequent effect on output with amplifier gain changes will be minimized.

With reference to FIG. 4(*b*), contamination will cause the signal $V_1$ to steadily decrease for paper absent conditions as shown by the decreasing ramp wave form. However, when the voltage $V_1$ reaches and becomes lower than the auto gain reference level, shown by the dotted line, the AND gate 66 is activated to enable signal to pass to the Ripple counter 68. The output of the Ripple counter 68 is converted to an analog signal $V_g$ to increase the gain of amplifier 62 raising the output voltage $V_1$ of amplifier 62 back to a level of approximately 5 volts.

With reference to FIG. 6, there is shown an alternate, control circuit. In particular, the amplifier is now a four-stage digital amplifier having a preamp stage 73, a 1x, 3x stage 74, a 1x, 9x stage 76, and a 1x, 81x stage 78. In addition, there is shown a pulse generator 80 and an OR-gate 82 for calibrating the circuitry in order that the $V_1$ voltage from the four-stage amplifier is greater than the reference voltage $V_{REF}$. Both the reference voltage $V_{REF}$ and the voltage $V_1$ are applied to comparator 84. The output of comparator 84 is one input to AND gate 86.

In operation, if the voltage $V_1$ remains greater than the reference voltage $V_{REF}$, there is a relatively low voltage output to one leg of the AND gate 86 and the AND gate is driven off. Both inputs have to be high to the AND gate 86 for the AND gate to transmit pulses. If $V_1$ is less than the reference voltage, there will be a relatively high output voltage to one input to the AND gate 86. The AND gate 86 will transmit pulses from OR Gate 82. This will provide enable signals to counter 88.

Each 1x, 3x stage of the amplifier is connected to the counter 88. As illustrated in a table below, the output of the counter to each of the amplifiers stages will provide various combinations of the total gain of the amplifier. For example, a 000 output of the counter results in $1\times1\times1$ or a 1x gain. An output of 001 results in $3\times1\times1$ or a 3x gain. Similarly, a 011 output results in a $3\times9\times1$ or 27x gain.

TABLE

| COUNTER | | | GAIN |
|---|---|---|---|
| 0 | 0 | 0 | $1 \times 1 \times 1 = 1$ |
| 0 | 0 | 1 | $3 \times 1 \times 1 = 3$ |
| 0 | 1 | 0 | $1 \times 9 \times 1 = 9$ |
| 0 | 1 | 1 | $3 \times 9 \times 1 = 27$ |
| 1 | 0 | 0 | $1 \times 1 \times 81 = 81$ |
| 1 | 0 | 1 | $3 \times 1 \times 81 = 264$ |
| 1 | 1 | 0 | $1 \times 9 \times 81 = 729$ |
| 1 | 1 | 1 | $3 \times 9 \times 81 = 2187$ |

With reference to FIG. 7, there is shown an alternate preferred control circuit. In this scheme, the sensor is calibrated by transmitting the light emitted by an LED 92 through the document path while no document is present and detecting this light with a photodiode 94. The current induced in the photodiode is integrated until a voltage exceeds a certain threshold and trips a Schmitt trigger 96. The time, in clock pulses from master clock 97 required for this to happen is recorded in the control 98 and this value is fed into the "no paper" latch 100.

During normal operation, the number of clock pulses required to trip the Schmitt trigger 96 is compared in digital comparator 102 to the value stored in the latch 100. If this number exceeds two (2) times the no paper latch value, the output 104 of the sensor from the state control 105 is brought low, indicating the presence of a document. Otherwise, this output 101 is held high, thus indicating the absence of a document in the sensing area.

If during calibration, the 11th bit of the counter 98 is set to "1" then the "clean me" signal 106, from control logic 108 is brought low indicating that the sensor needs cleaning.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true sprit and scope of the present invention.

We claim:

1. A sensor device for sensing the presence of an object in a sensing station comprising:

a clock producing clock pulses;

a light source having its output directed at the sensing station;

phototransducer means, disposed in aligned relationship with a light source and responsive to the output from the light source for developing a detection signal in accordance with the presence of an object in the sensing station;

an amplifier electrically connected to the phototransducer, the amplifier responding to and integrating the detection signal of the phototransducer, and providing said integrated detection signal as an amplifier output signal;

a switch connected to the amplifier and energizable when the amplifier output signal exceeds a preselected value;

a counter for counting the number of pulses to energize the switch, said counter resettable upon energization thereof;

a latch means for storing a value representative of the number of clock pulses required to energize the switch in the absence of paper in the sensing station as a reference value;

a comparator for continuously comparing the number of clock pulses counted by said counter with said absence of paper value stored in said latch means; and control means for providing an output signal indicative of the presence or absence of an object in the sensor station in accordance with the comparison of the digital comparator falling within a predetermined range of values.

2. The sensor device of claim 1 including means providing a signal indicative of a cleaning requirement when said reference value exceeds a selected number of clock pulses.

* * * * *